US006634518B1

(12) United States Patent
Jones

(10) Patent No.: US 6,634,518 B1
(45) Date of Patent: Oct. 21, 2003

(54) SUCTION-ELIMINATED WASTE RECEPTACLE

(76) Inventor: Thomas M. Jones, 14004 - 59$^{th}$ Ave. E., Puyallup, WA (US) 98373

( * ) Notice: Subject to any disclaimer, the term of this patent is extended or adjusted under 35 U.S.C. 154(b) by 0 days.

(21) Appl. No.: 10/043,794

(22) Filed: Jan. 14, 2002

(51) Int. Cl.$^{7}$ ..... B65D 67/04
(52) U.S. Cl. ..... 220/495.04; 220/908.1
(58) Field of Search ..... 220/495.04, 908.1, 220/295.06

(56) References Cited

U.S. PATENT DOCUMENTS 4,294,379 A * 10/1981 Bard ..... 220/495.04
6,015,063 A * 1/2000 Poliquin ..... 220/495.04
6,079,759 A * 6/2000 Payne et al. ..... 220/495.04

* cited by examiner

*Primary Examiner*—Joseph M. Moy

(57) ABSTRACT

A suction-eliminated waste receptacle for releasing air trapped between the liner member and the container. The suction-eliminated waste receptacle includes a container having a bottom wall and an open top; and also includes a flexible liner member being removably disposed in the container; and further includes a tubular conduit member being disposed in the container between side and bottom walls of the container and the flexible liner member for allowing air to enter between the side and bottom walls of the container and the flexible liner member.

6 Claims, 4 Drawing Sheets

SUCTION-ELIMINATED WASTE RECEPTACLE

BACKGROUND OF THE INVENTION

1. Field of the Invention

The present invention relates to waste receptacles and more particularly pertains to a new suction-eliminated waste receptacle for releasing air trapped between the liner member and the container.

2. Description of the Prior Art

The use of waste receptacles is known in the prior art. More specifically, waste receptacles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,015,063; U.S. Pat. No. 5,375,732; U.S. Pat. No. 4,294,379; U.S. Pat. No. 5,492,24; U.S. Pat. No. 5,156,290; and U.S. Pat. No. Des. 398,117.

While these devices fulfill their respective, particular objectives and requirements, the aforementioned patents do not disclose a new suction-eliminated waste receptacle which is easily-removable from the container and which allows air to enter under the flexible liner member rather than on the sides of the flexible liner member as shown in the prior art.

SUMMARY OF THE INVENTION

In these respects, the suction-eliminated waste receptacle according to the present invention substantially departs from the conventional concepts and designs of the prior art, and in so doing provides an apparatus primarily developed for the purpose of releasing air trapped between the liner member and the container.

The general purpose of the present invention, which will be described subsequently in greater detail, is to provide a new suction-eliminated waste receptacle which has many of the advantages of the waste receptacles mentioned heretofore and many novel features that result in a new suction-eliminated waste receptacle which is not anticipated, rendered obvious, suggested, or even implied by any of the prior art waste receptacles, either alone or in any combination thereof. The inventive device includes a container having a bottom wall and an open top; and also includes a flexible liner member being removably disposed in the container; and further includes a tubular conduit member being disposed in the container between side and bottom walls of the container and the flexible liner member for allowing air to enter between the side and bottom walls of the container and the flexible liner member.

There has thus been outlined, rather broadly, the more important features of the suction-eliminated waste receptacle in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new suction-eliminated waste receptacle which has many of the advantages of the waste receptacles mentioned heretofore and many novel features that result in a new suction-eliminated waste receptacle which is not anticipated, rendered obvious, suggested, or even implied by any of the prior art waste receptacles, either alone or in any combination thereof.

Still another object of the present invention is to provide a new suction-eliminated waste receptacle for releasing air trapped between the liner member and the container.

Still yet another object of the present invention is to provide a new suction-eliminated waste receptacle that is easy and convenient to use.

Even still another object of the present invention is to provide a new suction-eliminated waste receptacle that prevents the flexible liner member from sticking to the walls of the container thus allowing the user to more easily remove the flexible liner member from the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF SHE PREFERRED EMBODIMENT

Figure 1:
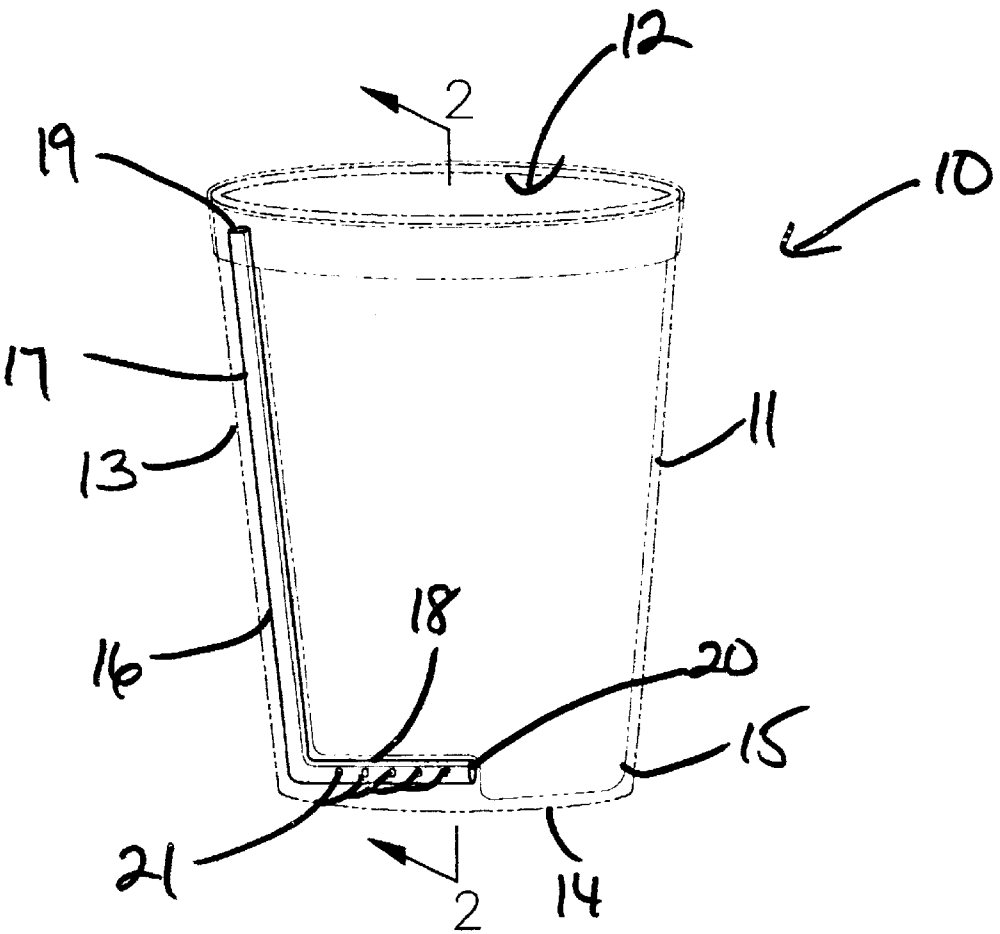
FIG. 1 is a perspective view of a new suction-eliminated waste receptacle according to the present invention and shown in use.
Figure 2:
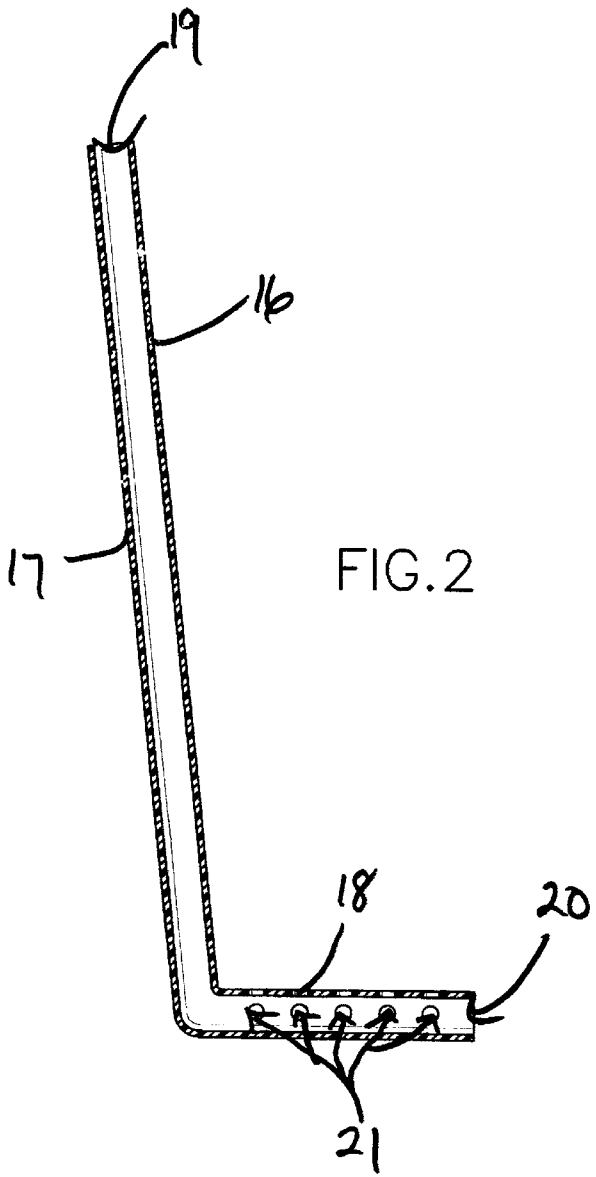
FIG. 2 is a cross-sectional view of the air conduit member of the present invention.
Figure 3:
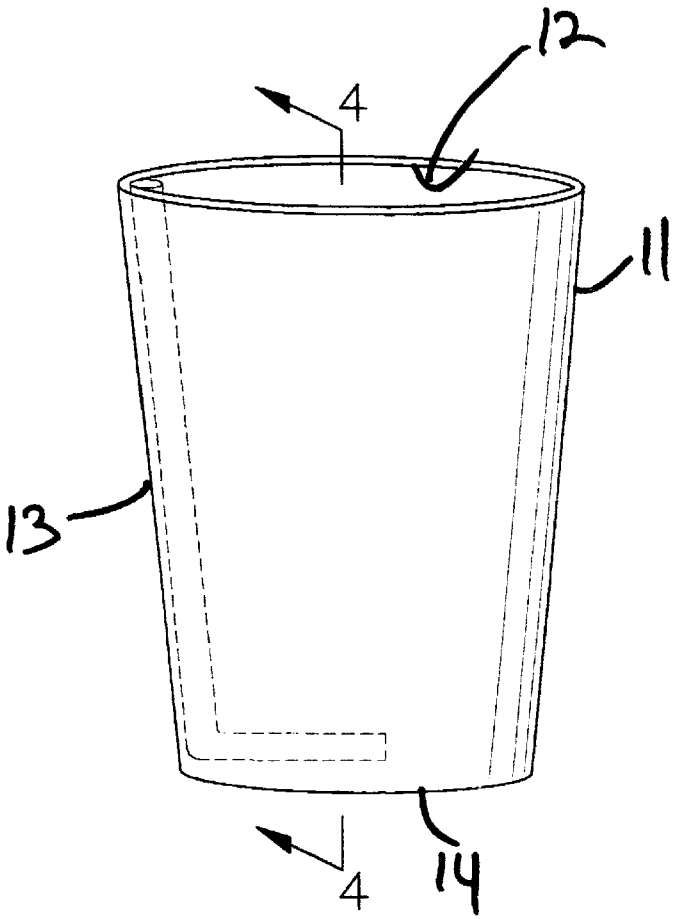
FIG. 3 is a side elevational view of the present invention.
Figure 4:
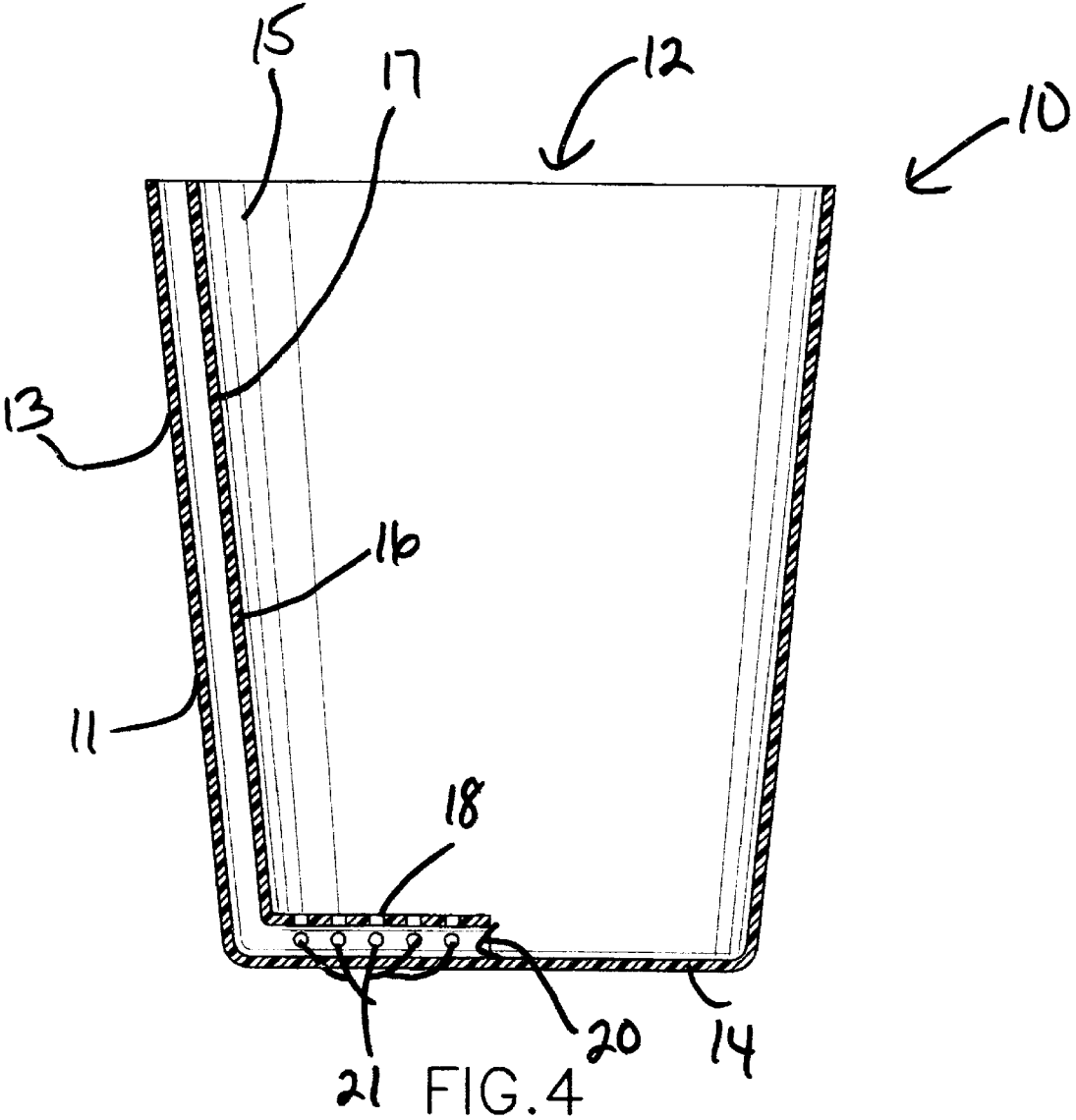
FIG. 4 is a side elevational view of a second embodiment of the present invention

With reference now to the drawings, and in particular to FIGS. 1 through 4 thereof, a new suction-eliminated waste receptacle embodying the principles and concepts of the present invention and generally designated by the reference numeral 10 will be described.

As best illustrated in FIGS. 1 through 4, the suction-eliminated waste receptacle 10 generally comprises a container 11 having a bottom wall 14 and an open top 12. A flexible liner member 15 is removably disposed in the container 11. A tubular conduit member 16 is disposed in the container 11 between side and bottom walls 13,14 of the container 11 and the flexible liner member 15 for allowing air to enter between the side and bottom walls 13,14 of the container 11 and the flexible liner member 15. The tubular conduit member 16 is removably disposed in the container 11 and includes an elongate first portion 17, an elongate second portion 18 which is angled relative to the elongate first portion 17, an air inlet port 19, and an air outlet port 20. The elongate second portion 18 is positioned upon the bottom wall 14 of the container 11 and the elongate first portion 17 is positioned against the side wall 13 of the container 11. The elongate second portion 18 has a plurality of holes 21 being spaced apart and being extended through a wall of the elongate second portion 18 into a bore of the tubular conduit member 16. The elongate second portion 18 is removably disposed beneath the flexible liner member 15 with the air inlet port 18 being directed out of the container 11.

As a second embodiment, the tubular conduit member 15 is fixedly attached in the container 11. The tubular conduit member 15 includes an elongate first portion 17 having a wall of which a portion is formed by a portion of the side wall 13 of the container 11, and also includes an elongate second portion 18 having a wall of which a portion is formed by a portion of the bottom wall 14 of the container 11, and further includes inlet and outlet ports 18,19. The elongate second portion 19 is angled relative to the elongate first portion 18 and has a plurality of holes 21 being spaced apart and being extended through the wall thereof.

In use, the user inserts the flexible liner member 15 into the container 11 with the elongate second portion 18 being disposed upon the bottom wall 14 of the container 11 between the bottom of the flexible liner member 15 and the container 11 so that after trash is placed into the flexible liner member 15, the user will be able to easily remove the flexible liner member 15 from the container 11, because the tubular conduit member 16 allows air to enter the container 11 beneath the flexible liner member 15 to eliminate any suction of the flexible liner member 15 to the container 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the suction-eliminated waste receptacle. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A suction-eliminated waste receptacle comprising:

a container having a bottom wall and an open top;

a flexible liner member being removably disposed in said container; and a tubular conduit member being disposed in said container between side and bottom walls of said container and said flexible liner member for allowing air to enter between said side and bottom walls of said container and said flexible liner member, said tubular conduit member being removably disposed in said container and including a elongate first portion, a elongate second portion which is angled relative to said elongate first portion, an air inlet port, and an air outlet port, said elongate second portion being positioned upon said bottom wall of said container and said elongate first portion being positioned against a side wall of said container.

2. A suction-eliminated waste receptacle as described in claim 1, wherein said elongate second portion has a plurality of holes being spaced apart and being extended through a wall of said elongate second portion into a bore of said tubular conduit member.

3. A suction-eliminated waste receptacle as described in claim 2, wherein said elongate second portion is disposed beneath said flexible liner member.

4. A suction-eliminated waste receptacle as described in claimed 3, wherein said air inlet port is directed out of said container.

5. A suction-eliminated waste receptacle comprising:

a container having a bottom wall and an open top;

a flexible liner member being removably disposed in said container; and a tubular conduit member being disposed in said container between side and bottom walls of said container and said flexible liner member for allowing air to enter between said side and bottom walls of said container and said flexible liner member, said tubular conduit member including an elongate first portion having a wall of which a portion is formed by a portion of a side wall of said container, and also including an elongate second portion having a wall of which a portion is formed by a portion of said bottom wall of said container, and further including inlet and outlet ports.

6. A suction-eliminated waste receptacle as described in claims 5, wherein said elongate second portion is angled relative to said elongate first portion and has a plurality of holes being spaced apart and being extended through said wall thereof.

* * * * *